US012703590B2

(12) United States Patent
Miyamoto

(10) Patent No.: US 12,703,590 B2
(45) Date of Patent: Aug. 11, 2026

(54) SHEET FEEDING DEVICE, IMAGE FORMING APPARATUS, AND LOCKING DEVICE

(71) Applicant: SEIKO EPSON CORPORATION, Tokyo (JP)

(72) Inventor: Yuji Miyamoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 148 days.

(21) Appl. No.: 18/350,676

(22) Filed: Jul. 11, 2023

(65) Prior Publication Data

US 2024/0017943 A1 Jan. 18, 2024

(30) Foreign Application Priority Data

Jul. 12, 2022 (JP) ..... 2022-111573

(51) Int. Cl.
*B65H 1/26* (2006.01)
*B65H 1/04* (2006.01)

(52) U.S. Cl.
CPC ..... *B65H 1/266* (2013.01); *B65H 1/04* (2013.01); *B65H 2402/60* (2013.01); *B65H 2405/121* (2013.01); *B65H 2405/332* (2013.01)

(58) Field of Classification Search
CPC ..... B65H 1/04; B65H 1/266; B65H 2402/44; B65H 2402/441; B65H 2402/45; B65H 2402/60; B65H 2405/11; B65H 2405/113; B65H 2405/115; B65H 2405/12; B65H 2405/121; B65H 2405/332
See application file for complete search history.

(56) References Cited

U.S. PATENT DOCUMENTS

2004/0251597 A1* 12/2004 Ito ..... B65H 1/266 271/145
2007/0251405 A1* 11/2007 Kurokawa ..... B41J 13/103 101/494
2010/0102503 A1* 4/2010 Palumbo ..... B65H 1/266 271/145
2010/0194026 A1 8/2010 Iguchi
(Continued)

FOREIGN PATENT DOCUMENTS

CN 2926424 7/2007
CN 205489221 8/2016
CN 209322347 8/2019
(Continued)

*Primary Examiner* — Prasad V Gokhale
(74) *Attorney, Agent, or Firm* — WORKMAN NYDEGGER

(57) ABSTRACT

A sheet feeding device includes a plurality of containers configured to store sheet members, a housing in which the plurality of containers are mounted from a front, and a locking device configured to restrict withdrawal of the plurality of containers mounted in the housing, wherein a first opening portion is provided in a front surface of each of the plurality of containers, the housing includes a first engaged portion, and the locking device includes an engaging portion that is inserted into the first opening portion and engaged with the first engaged portion located further, in a depth direction, than the first opening portion, a restricting portion that restricts disengagement of the engaging portion, and a contact portion that comes into contact with the front surfaces of the plurality of containers.

19 Claims, 14 Drawing Sheets

(56) References Cited

U.S. PATENT DOCUMENTS

| | | | | |
|---|---|---|---|---|
| 2017/0308029 | A1* | 10/2017 | Soda | G03G 21/1647 |
| 2018/0127222 | A1* | 5/2018 | Kuno | B65H 1/266 |

FOREIGN PATENT DOCUMENTS

| | | | |
|---|---|---|---|
| JP | 2004075293 | | 3/2004 |
| JP | 2008137747 | | 6/2008 |
| JP | 2009120399 | | 6/2009 |
| JP | 2020-105874 | A | 7/2020 |
| WO | 2016163875 | | 10/2016 |

* cited by examiner

SHEET FEEDING DEVICE, IMAGE FORMING APPARATUS, AND LOCKING DEVICE

The present application is based on, and claims priority from JP Application Serial Number 2022-111573, filed Jul. 12, 2022, the disclosure of which is hereby incorporated by reference herein in its entirety.

BACKGROUND

1. Technical Field

The present disclosure relates to a sheet feeding device, an image forming apparatus, and a locking device.

2. Related Art

For example, as disclosed in JP-A-2020-105874, there is an image forming apparatus including a storage unit which is an example of a housing. The storage unit stores a plurality of sheet feed cassettes each of which is an example of a container for storing printing paper which is an example of a sheet member. Each of the sheet feed cassettes is drawn out of a front surface of the storage unit.

The image forming apparatus includes a locking device. The locking device includes a fixing portion, a stopper portion, and a lock portion. The fixing portion is provided on a side surface of the storage unit. The stopper portion is rotatably mounted on the fixing portion. When the stopper portion is located on the side surface, the plurality of sheet feed cassettes are able to be drawn out. The stopper portion located on the front surface makes it difficult to take out the plurality of sheet feed cassettes. The lock portion locks the stopper portion located on the front surface.

The stopper portion in JP-A-2020-105874 rotates from the side surface to the front surface. An operator operates and locks the lock portion from the side surface in a state in which the stopper portion is located on the front surface. Therefore, a space for rotating the stopper portion and operating the lock portion is required around the locking device.

SUMMARY

A sheet feeding device that solves the above problems includes a plurality of containers configured to store sheet members, a housing in which the plurality of containers are mounted from a front thereof, and a locking device configured to restrict withdrawal of the plurality of containers mounted in the housing, wherein an opening portion is provided in a front surface of each of the plurality of containers, the housing includes an engaged portion, and the locking device includes an engaging portion that is inserted into the opening portion and engaged with the engaged portion located further, in a depth direction, than the opening portion, a restricting portion that restricts disengagement of the engaging portion, and a contact portion that comes into contact with the front surfaces of the plurality of containers.

A sheet feeding device that solves the above problems includes a plurality of containers configured to store sheet members, a housing in which the plurality of containers are mounted from a front, and a locking device configured to restrict withdrawal of the plurality of containers mounted in the housing, wherein a plurality of opening portions are provided in a side surface of the housing, each of the plurality of containers has an engaged portion, and the locking device includes a plurality of engaging portions that are inserted into the opening portions and are engaged with the engaged portions located further, in a depth direction, than the plurality of opening portions, and a restricting portion that restricts disengagement of the plurality of engaging portions.

An image forming apparatus that solves the above problems includes the sheet feeding device configured as described above and an image forming unit configured to form an image on the sheet member.

A locking device that solves the above problems is a locking device that restricts withdrawal of a plurality of containers mounted in a housing from a front, including a pair of engaging portions that are respectively engaged with a pair of engaged portions of the housing or the container, and a restricting portion that restricts disengagement of the pair of engaging portions, wherein the locking device is detachably mounted to a front surface of the container or a side surface of the housing from the outside.

DESCRIPTION OF EXEMPLARY EMBODIMENTS

First Embodiment

Figure 1:
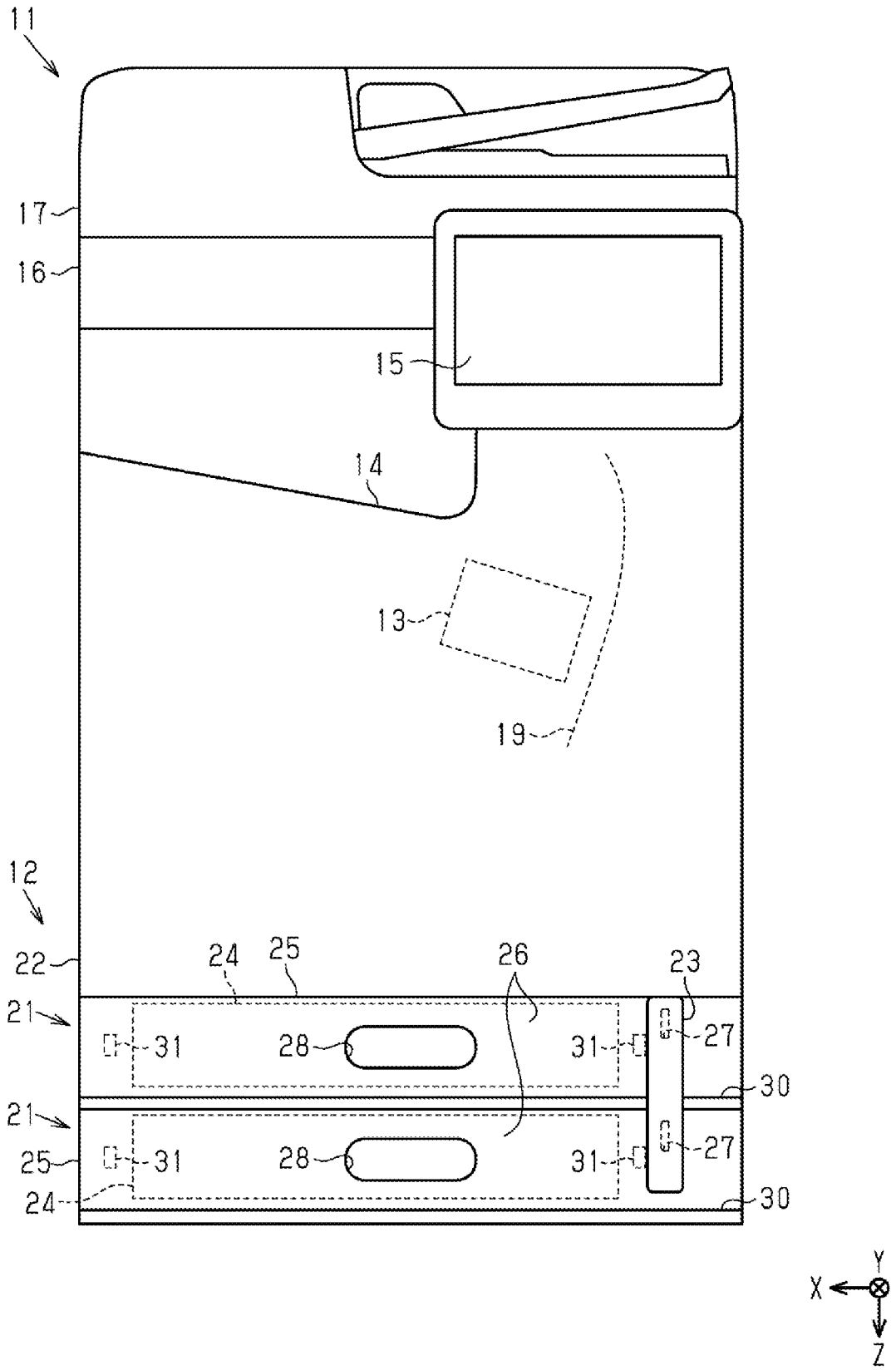
FIG. 1 is a schematic front view of a first embodiment of an image forming apparatus.

A first embodiment of a sheet feeding device, an image forming apparatus, and a locking device will be described below with reference to the drawings. The image forming apparatus is, for example, an inkjet printer that performs printing by ejecting ink onto a sheet member such as paper, roll paper, thermal paper, an envelope, a postcard, or a plastic sheet.

In the drawings, a Z axis represents the direction of gravity and X and Y axes represent directions along a horizontal plane, assuming that an image forming apparatus 11 is placed on the horizontal plane. The X axis, the Y axis, and the Z axis are orthogonal to one another. When an operator faces a front surface of the image forming apparatus 11, the Y axis represents an inward direction of the image forming apparatus 11, and the X axis represents a width direction of the image forming apparatus 11. In the following description, an X axis direction is also referred to as a width direction X, a Y axis direction is referred to as an inward direction Y, and a Z axis direction is referred to as a vertical direction Z.

Image Forming Apparatus

As illustrated in FIG. 1, the image forming apparatus 11 may include a sheet feeding device 12, an image forming unit 13, a stacker 14, an operation panel 15, an image reading unit 16, and an automatic feeding unit 17.

The image forming unit 13 forms an image on a sheet member 19. The image may include characters, lines, pictures, photographs, and the like. The image forming unit 13 of this embodiment forms an image by ejecting ink from one or more nozzles (not illustrated). The image forming unit 13 may eject ink toward the sheet member 19 being transported.

The stacker 14 stores the sheet member 19 on which the image is formed. The operation panel 15 is, for example, a touch panel for operating the image forming apparatus 11. The operation panel 15 may be provided to face a front of the image forming apparatus 11. The image reading unit 16 reads an image of a document. The automatic feeding unit 17 feeds a document to the image reading unit 16.

Sheet Feeding Device

The sheet feeding device 12 includes a plurality of containers 21, a housing 22, and a locking device 23. The plurality of containers 21 of this embodiment have the same configuration. Therefore, overlapping description will be omitted by denoting common constituents with the same reference numerals.

The container 21 can store the sheet member 19. When the sheet member 19 is paper, the container 21 may store a bundle of the sheet members 19 before printing. The container 21 is, for example, a sheet feed cassette.

The container 21 may include a storing portion 24 and a front plate 25. The storing portion 24 and the front plate 25 may be integrally formed. The storing portion 24 stores the sheet member 19. In the width direction X, the front plate 25 is larger than the storing portion 24. In a state in which the container 21 is mounted in the housing 22, the storing portion 24 is located inside the housing 22, whereas the front plate 25 is located outside the housing 22. That is, the front plate 25 covers a part of the housing 22 from a front surface thereof.

A first opening portion 27 which is an example of an opening portion is provided in a front surface 26 of the container 21. The first opening portion 27 passes through the front plate 25 in the inward direction Y. The first opening portion 27 may be provided at a position different from that of the storing portion 24 in the width direction X. The front surface 26 is a surface of the front plate 25 and is a surface facing the front. The container 21 may include a handle 28 provided on the front surface 26. In a case in which there is one handle 28, when the handle 28 is provided at a position overlapping the storing portion 24 in the width direction X, the container 21 can be easily drawn out.

The plurality of containers 21 are mounted in the housing 22 from the front. The housing 22 may include a mounting portion 30 and a rail 31. The housing 22 may include the same number of mounting portions 30 as the number of mountable containers 21. One or more rails 31 may be provided for one mounting portion 30. The rail 31 of this embodiment is provided parallel to the Y axis. The rail 31 guides the container 21 pushed into the mounting portion 30 from the front in the inward direction Y. The rail 31 guides the container 21 pulled out of the mounting portion 30 in a direction opposite to the inward direction Y.

Figure 2:
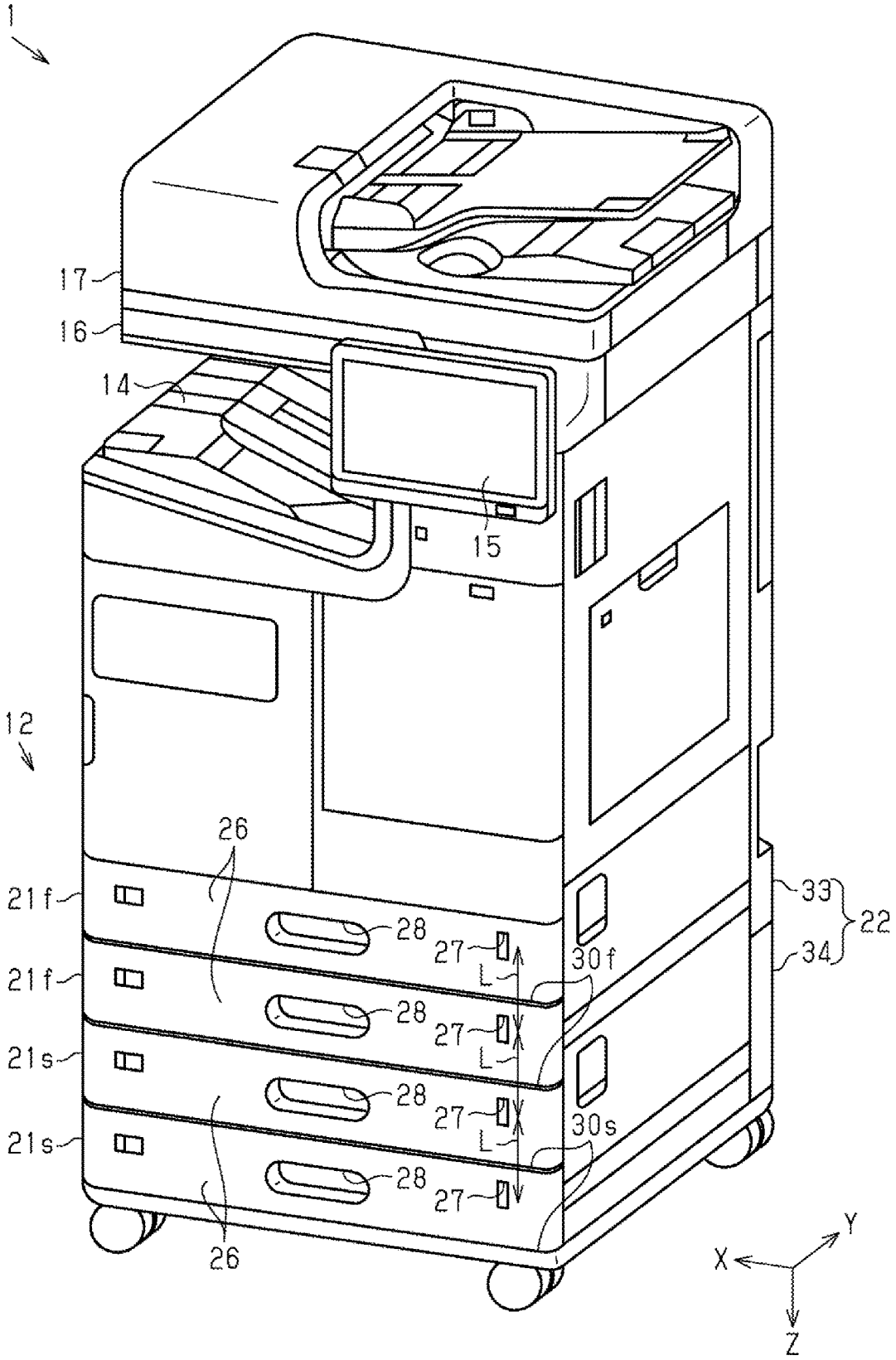
FIG. 2 is a perspective view of the image forming apparatus to which attachments are added.

As illustrated in FIG. 2, the sheet feeding device 12 includes two first containers 21*f* and two second containers 21*s* which are examples of containers. When the first container 21*f* and the second container 21*s* are not distinguished from each other, they are also simply referred to as containers 21. The sheet feeding device 12 may include three or more containers 21. The plurality of containers 21 may be provided side by side in the vertical direction Z. The sheet feeding device 12 may include a plurality of locking devices 23 which are not illustrated in FIG. 2. Intervals L among the first opening portions 27 of the adjacent containers 21 may be the same. When the intervals L are the same, for example, the upper two containers 21 and the lower two containers 21 can be locked by the same locking device 23, that is, the locking device 23 having a common specification.

The housing 22 may include a main body 33 and one or more attachments 34. The attachments 34 may be detachable from the main body 33. The attachments 34 may be mountable on the main body 33 afterward. The attachments 34 are added to the main body 33.

Among the plurality of containers 21, the container mounted in the main body 33 is also referred to as a first container 21*f*, and the container mounted in the attachment 34 is also referred to as a second container 21*s*. Among the plurality of mounting portions 30, a mounting portion in which the first container 21*f* is mounted is also referred to as a first mounting portion 30*f*, and a mounting portion in which the second container 21*s* is mounted is also referred to as a second mounting portion 30*s*. That is, the main body 33 includes the first mounting portion 30*f*. The attachment 34 includes the second mounting portion 30*s*. The main body 33 may include one or more first mounting portions 30*f*. The attachment 34 may include one or more second mounting portions 30*s*.

Figure 3:
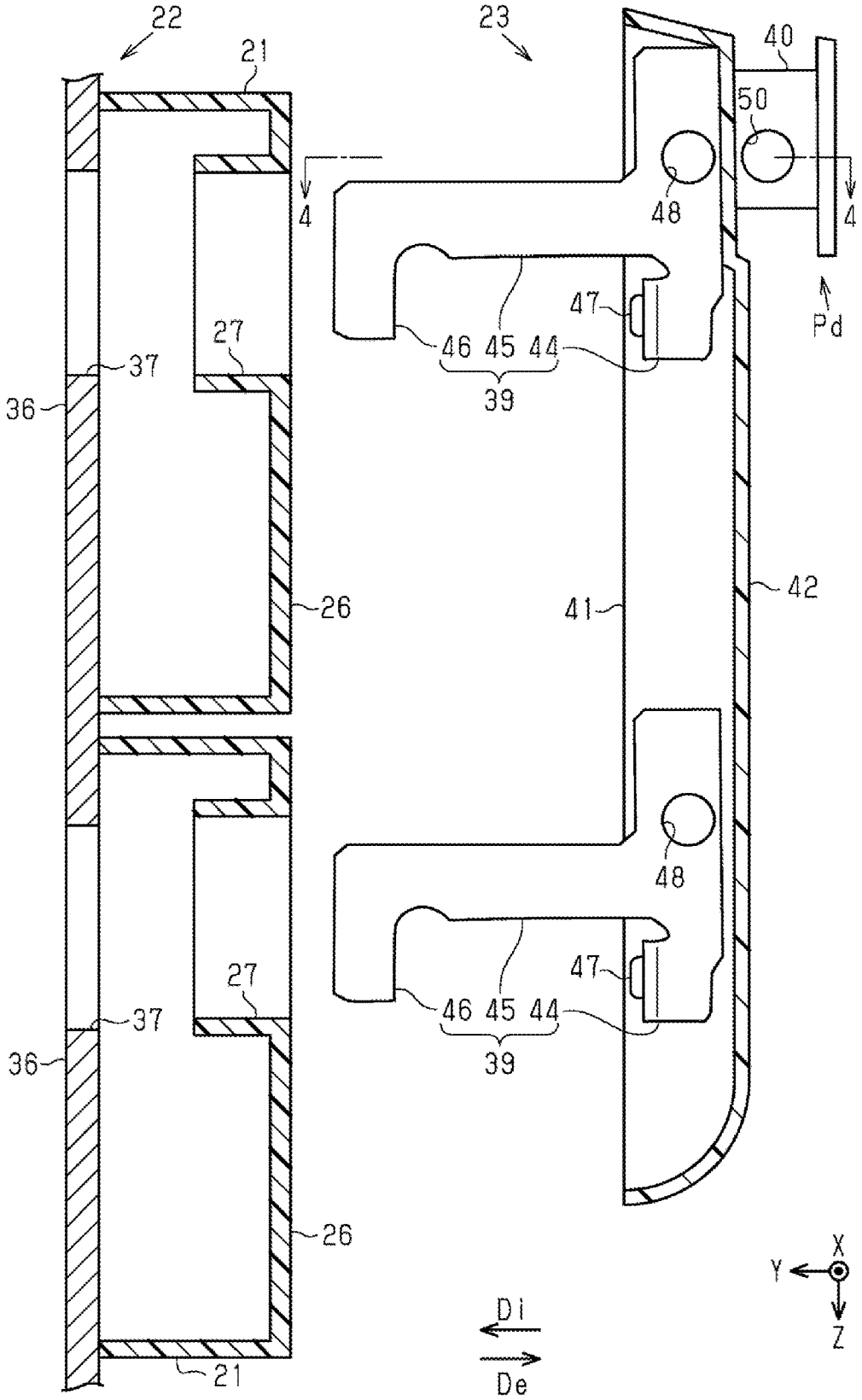
FIG. 3 is a schematic cross-sectional view of a locking device.

As illustrated in FIG. 3, the housing 22 includes a first engaged portion 36 which is an example of the engaged portion. The housing 22 may include a first insertion portion 37. The housing 22 may include a plurality of first engaged portions 36 and a plurality of first insertion portions 37. The first insertion portion 37 is, for example, a hole provided in the housing 22. The first engaged portion 36 and the first insertion portion 37 are located inward with respect to the first opening portion 27 in an insertion direction Di in a state in which the container 21 is mounted in the mounting portion 30. The first opening portion 27 and the first insertion portion 37 are arranged in the insertion direction Di. The first engaged portion 36 of this embodiment is located below the first insertion portion 37. The insertion direction Di of this embodiment is a direction parallel to the Y axis. The insertion direction Di is a direction perpendicular to the front surface 26 in which the first opening portion 27 is provided. In this embodiment, a direction opposite to the insertion direction Di is also referred to as a removal direction De.

Locking Device

As illustrated in FIG. 3, the locking device 23 includes an engaging portion 39, a restricting portion 40, and a contact portion 41. The locking device 23 may include a holding portion 42.

The locking device 23 of this embodiment includes two engaging portions 39. The pair of engaging portions 39 may have the same shape. Each of the pair of engaging portions 39 is fixed to the holding portion 42. The holding portion 42 holds the pair of engaging portions 39 at a constant interval. The contact portion 41 is a portion of the holding portion 42 that can comes into contact with the container 21.

The engaging portion 39 is a planar plate made of a metal, for example. The engaging portion 39 may be partially bent. The engaging portion 39 may include a base portion 44, an arm portion 45, and a protruding portion 46. In the engaging portion 39, the base portion 44 may be fixed to the holding portion 42 by a screw 47 as a fastening member. A third hole 48 may be formed in the base portion 44. The arm portion 45 extends from the base portion 44 in the insertion direction Di. The protruding portion 46 protrudes downward from a distal end of the arm portion 45. A size of the protruding portion 46 in the vertical direction Z is larger than a size of the arm portion 45.

Figure 7:
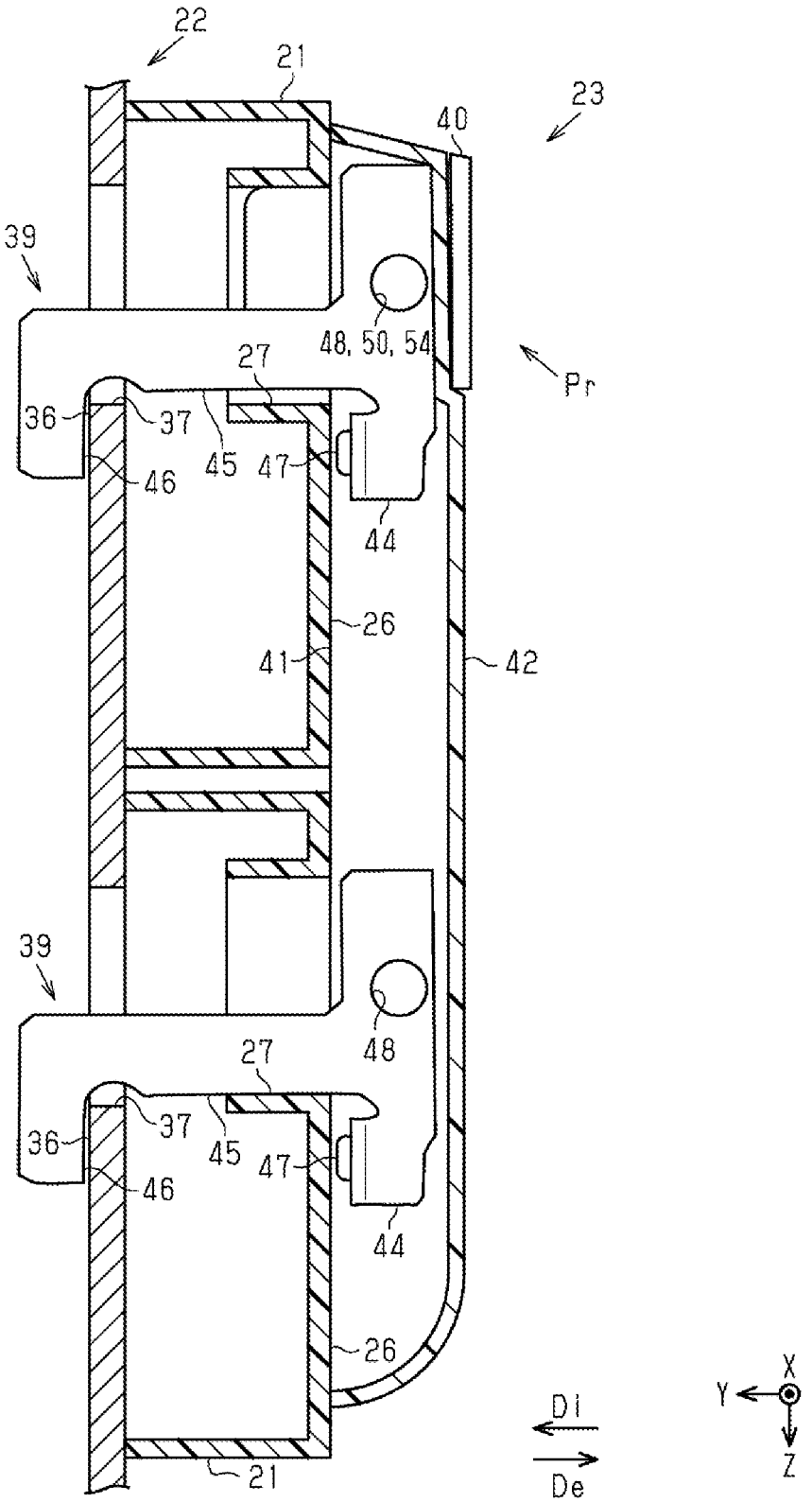
FIG. 7 is a schematic cross-sectional view of a locking device that locks a container.

The restricting portion 40 may be slidable between a restriction position Pr illustrated in FIG. 7 and a release position Pd illustrated in FIG. 3 different from the restriction position Pr. A first hole 50 is provided in the restricting portion 40.

Figure 4:
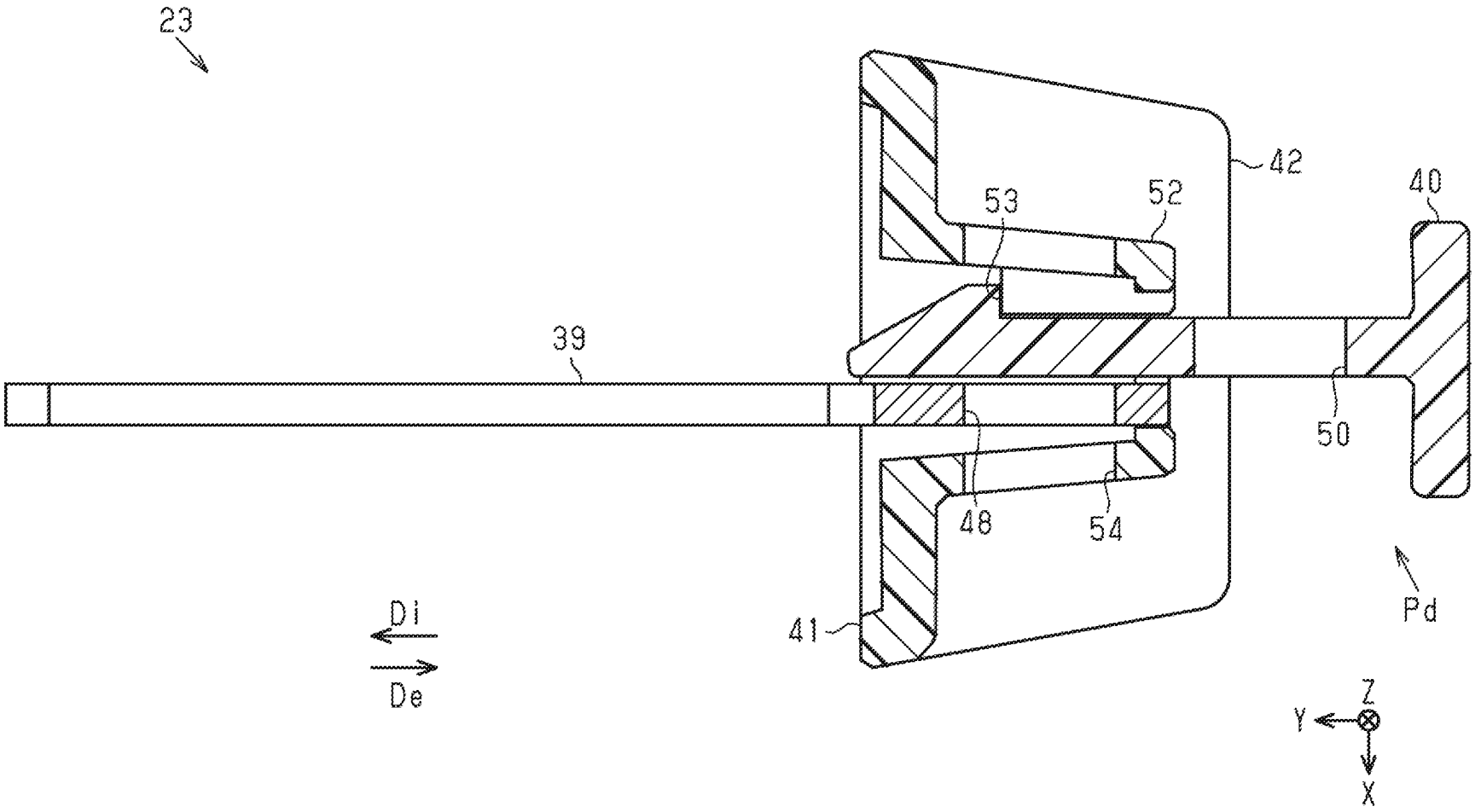
FIG. 4 is a cross-sectional view taken along line 4-4 in FIG. 3.

FIG. 4 is a cross-sectional view taken along line 4-4 in FIG. 3. As illustrated in FIG. 4, the locking device 23 may include a guiding portion 52 and a stopping portion 53.

The stopping portion 53 stops movement of the restricting portion 40 in a removal direction De. The stopping portion 53 stops the restricting portion 40 at the release position Pd, thereby reducing a possibility that the restricting portion 40 comes off.

The guiding portion 52 guides the movement of the restricting portion 40. A second hole 54 may be provided in the guiding portion 52. The second hole 54 passes through the guiding portion 52 in the width direction X. The second hole 54 is located at the same position as that of the third hole 48 in the vertical direction Z and the inward direction Y. That is, the second hole 54 overlaps the third hole 48 when seen in the width direction X.

Operation of First Embodiment

The operation of this embodiment will be described.

As illustrated in FIG. 1, the locking device 23 is detachably mounted on the front surface of the container 21 from the outside.

As illustrated in FIG. 3, when the locking device 23 is mounted, the operator moves the locking device 23 in the insertion direction Di in a state in which a height of the engaging portion 39 and a height of the first opening portion 27 are matched. The engaging portion 39 is inserted into the first opening portion 27.

Figure 5:
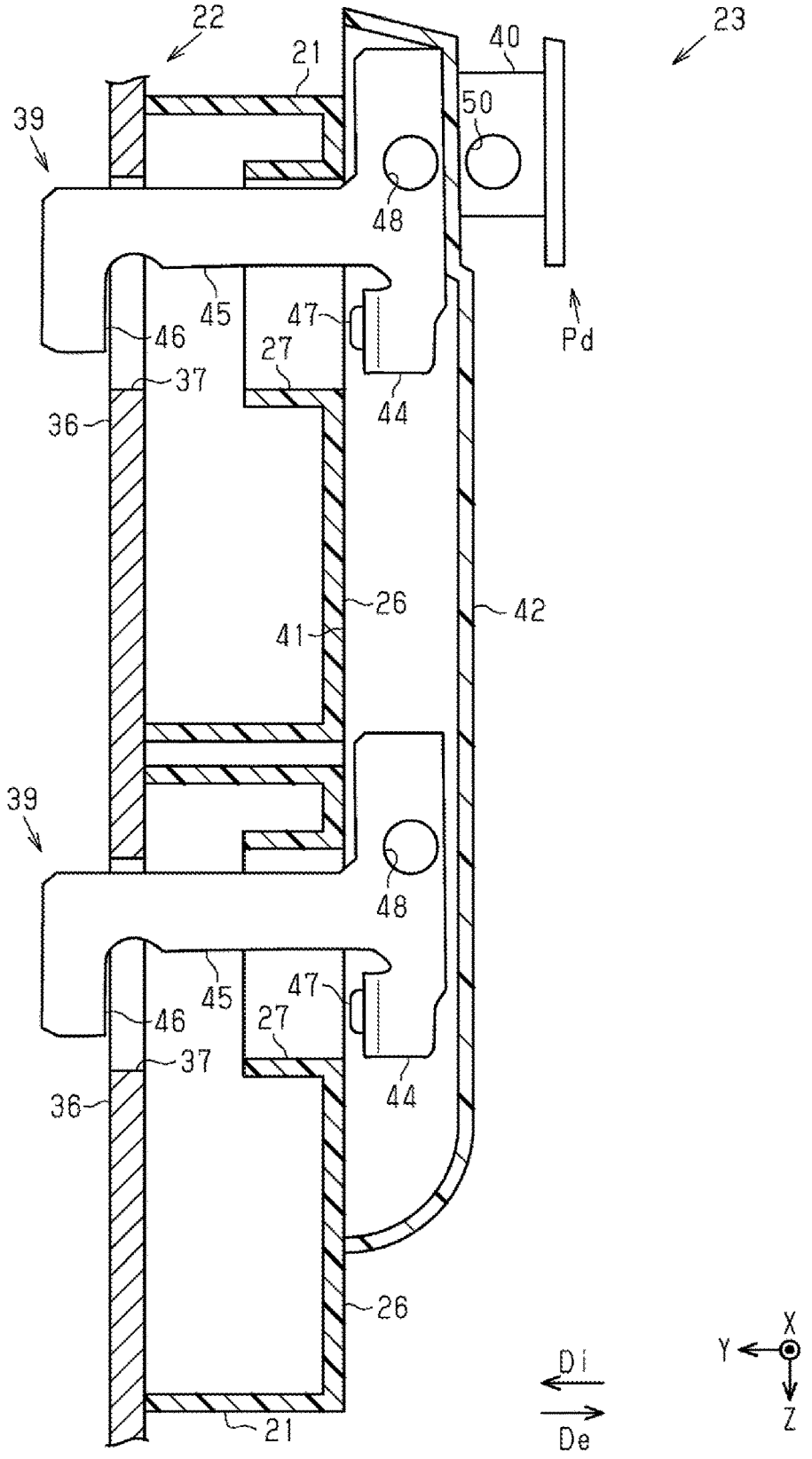
FIG. 5 is a schematic cross-sectional view of the locking device inserted into a first opening portion.

As illustrated in FIG. 5, the protruding portion 46 passes through the first opening portion 27 and the first insertion portion 37 and moves to a position deeper than the first engaged portion 36. The movement of the locking device 23 in the insertion direction Di is stopped by the contact portion 41 coming into contact with the front surfaces 26 of the plurality of containers 21.

Figure 6:
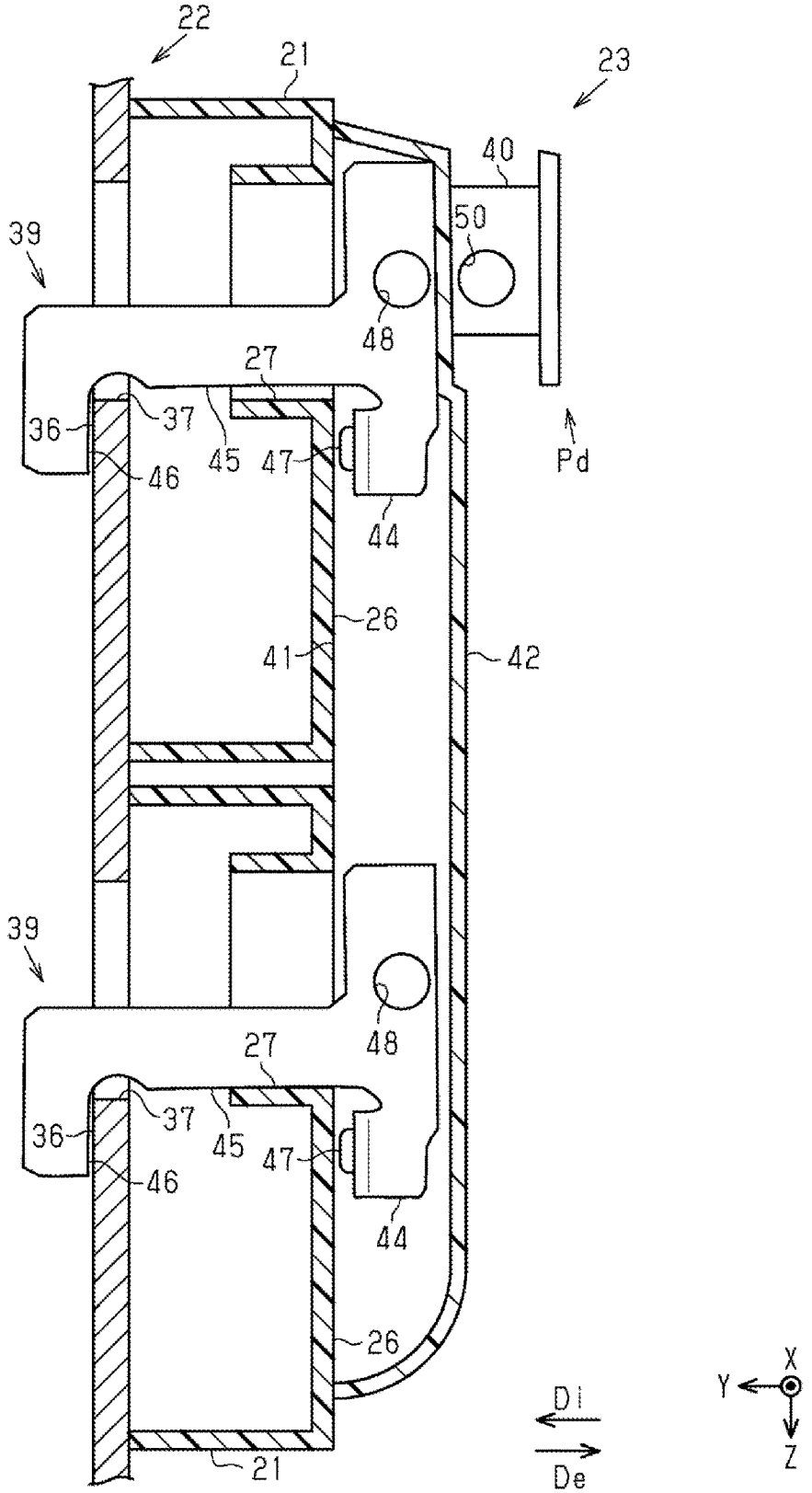
FIG. 6 is a schematic cross-sectional view of the locking device in which an engaging portion engages with a first engaged portion.

As illustrated in FIG. 6, when the operator moves the locking device 23 downward, the engaging portion 39 comes into contact with the first engaged portion 36. That is, the engaging portion 39 is inserted into the first opening portion 27 and is engaged with the first engaged portion 36 located further, in the depth direction, than the first opening portion 27. The protruding portion 46 is engageable with the first engaged portion 36. The engaging portion 39 restricts the movement of the locking device 23 in the removal direction De due to the protruding portion 46 coming into contact with the first engaged portion 36. The contact portion 41 restricts the movement of the locking device 23 in the insertion direction Di by coming into contact with the container 21. Therefore, the locking device 23 locks the container 21 by sandwiching the housing 22 and the container 21 in the inward direction Y with the engaging portion 39 and the contact portion 41. The two engaging portions 39 lock two adjacent containers 21. The locking device 23 restricts drawing out of the plurality of containers 21 mounted in the housing 22.

As illustrated in FIG. 7, when the operator pushes the restricting portion 40 in the insertion direction Di, the restricting portion 40 moves to the restriction position Pr. The restricting portion 40 moves to the restriction position Pr in a state in which the pair of engaging portions 39 are engaged with the first engaged portions 36. The restricting portion 40 located at the restriction position Pr restricts release of the engaging portion 39. Specifically, the restricting portion 40 restricts upward movement of the locking device 23 by coming into contact with an upper end of the upper first opening portion 27 of the two first opening portions 27. The lower engaging portion 39 of the two engaging portions 39 limits downward movement of the locking device 23 by coming into contact with a lower end of the lower first opening portion 27.

Figure 8:
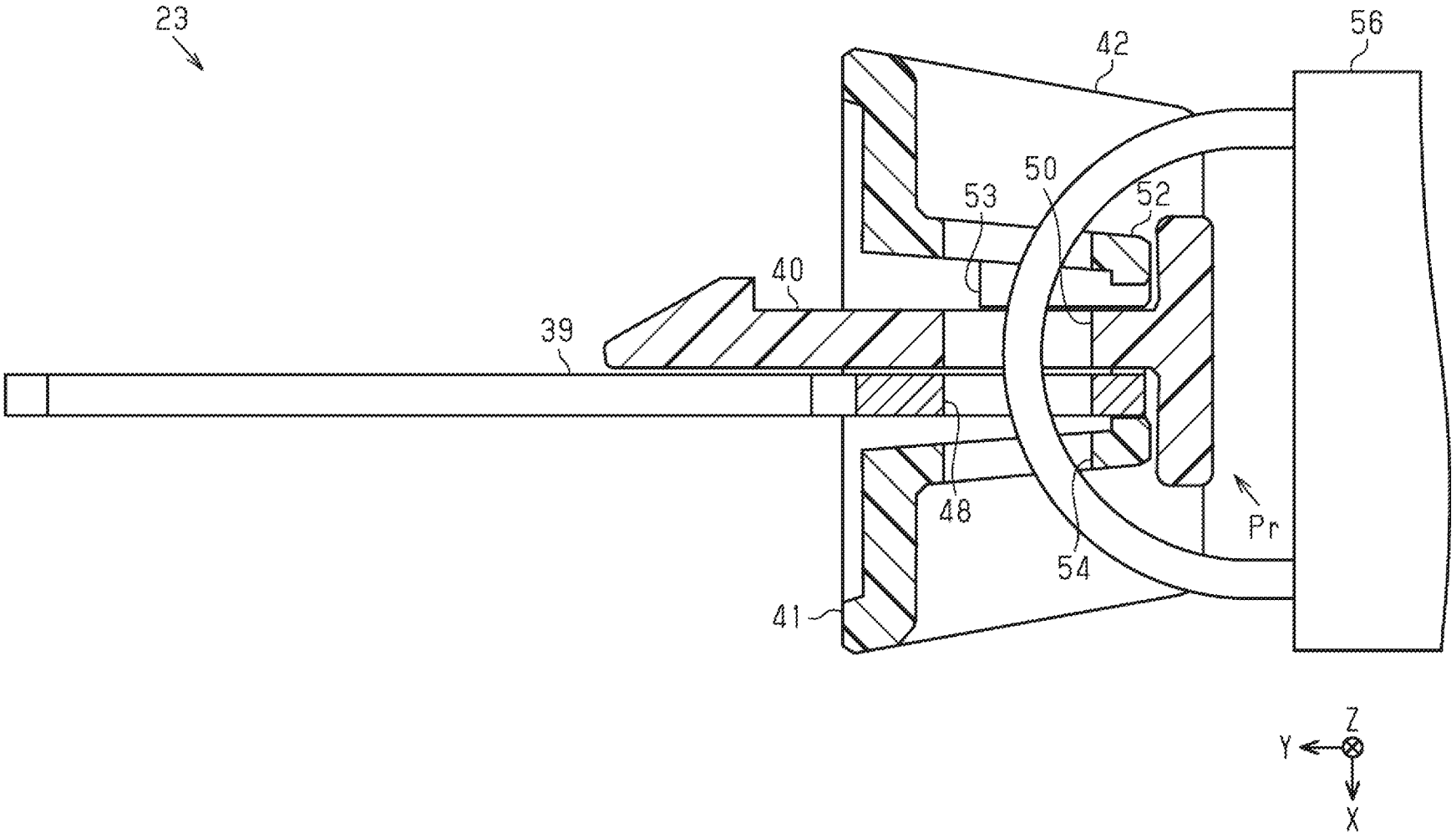
FIG. 8 is a schematic cross-sectional view of a locking device in which a lock is mounted.

As illustrated in FIG. 8, the first hole 50 and the second hole 54 overlap each other in a state in which the restricting portion 40 is located at the restriction position Pr. In this embodiment, the first hole 50 of the restricting portion 40 located at the restriction position Pr overlaps the second hole 54 and the third hole 48 when seen in the width direction X. For example, the first hole 50, the second hole 54, and the third hole 48 which overlap each other can be locked with a lock 56 such as a padlock or a wire lock. The lock 56 restricts the movement of the restricting portion 40.

The locking device 23 is removed in the reverse order of its installation. The container 21 is drawn out forward of the housing 22 by pulling the handle 28 from the front in a state in which the locking device 23 is not installed. The sheet member 19 can be replenished or replaced by drawing out the container 21.

Effects of First Embodiment

Effects of this embodiment will be described.

(1) The movement of the locking device 23 is restricted by the engagement of the engaging portion 39 with the first engaged portion 36. The contact portion 41 comes into contact with the front surfaces 26 of the plurality of containers 21. That is, the locking device 23 can restrict the withdrawal of the plurality of containers 21 by pressing the plurality of containers 21 with the contact portion 41. The engaging portion 39 is inserted into the first opening portion 27 formed in the front surface 26 of the container 21 and is engaged with the first engaged portion 36 located further, in the depth direction, than the first opening portion 27. Therefore, the locking device 23 can be mounted from the front. Therefore, it is possible to reduce a space required to restrict the withdrawal of the plurality of containers 21.

(2) The guiding portion 52 slidably guides the restricting portion 40. Therefore, the restricting portion 40 can easily move between the restriction position Pr and the release position Pd. Therefore, the locking device 23 can be easily attached and detached.

(3) For example, when the protruding portion 46 protrudes upward, the engagement of the locking device 23 may be released by its own weight. In this regard, since the protruding portion 46 protrudes downward, it is possible to make the engagement less likely to be released.

(4) Since the engaging portion 39 is a metal planar plate, a strength thereof can be easily ensured. (5) The first opening portion 27 and the storing portion 24 are provided to be displaced from each other in the width direction X. A space into which the engaging portion 39 is inserted is required at the inside of the first opening portion 27. Therefore, it is possible to reduce the size in the inward direction Y compared to a case in which the storing portion 24 and the first opening portion 27 are provided at the same position in the width direction X.

(6) The first hole 50 and the second hole 54 overlap each other in a state in which the restricting portion 40 is located at the restriction position Pr. For example, the lock 56 such as a padlock, a wire lock or the like can be mounted in the overlapped first hole 50 and second hole 54. Therefore, the engaging portion 39 engaged with the first engaged portion 36 can be easily locked.

(7) The attachment 34 is attachable to and detachable from the main body 33. The container 21 can be added by mounting the attachment 34 on the main body 33. The locking device 23 can restrict the withdrawal of the plurality of containers 21 even when the container 21 can be added.

(8) In the three or more first opening portions 27, the intervals L between adjacent first opening portions 27 are the same. The locking device 23 includes two engaging portions 39. Therefore, any adjacent container 21 can be locked by the locking device 23.

(9) The pair of engaging portions 39 are engaged with the pair of first engaged portions 36, respectively, by the locking device 23 being mounted on the front surface of the container 21, and thus the withdrawal of the plurality of containers 21 is restricted. Therefore, it is possible to reduce the space required to restrict the withdrawal of the plurality of containers 21.

(10) The pair of engaging portions 39 are fixed to the holding portion 42. The pair of engaging portions 39 have the same shape. That is, since the pair of engaging portions 39 can be configured of a common component, it is possible to reduce the cost.

(11) The locking device 23 is mounted on the front surface of the sheet feeding device 12. Therefore, a user can easily recognize that the container 21 is locked. It is possible to reduce a possibility that a large force is applied to the container 21 by a user who does not notice that the container 21 is locked.

Second Embodiment

Next, a second embodiment of a sheet feeding device, an image forming apparatus, and a locking device will be described with reference to the drawings. The same constituents as those in the first embodiment are denoted by the same reference numerals, and redundant explanations will be omitted.

Sheet Feeding Device

Figure 9:
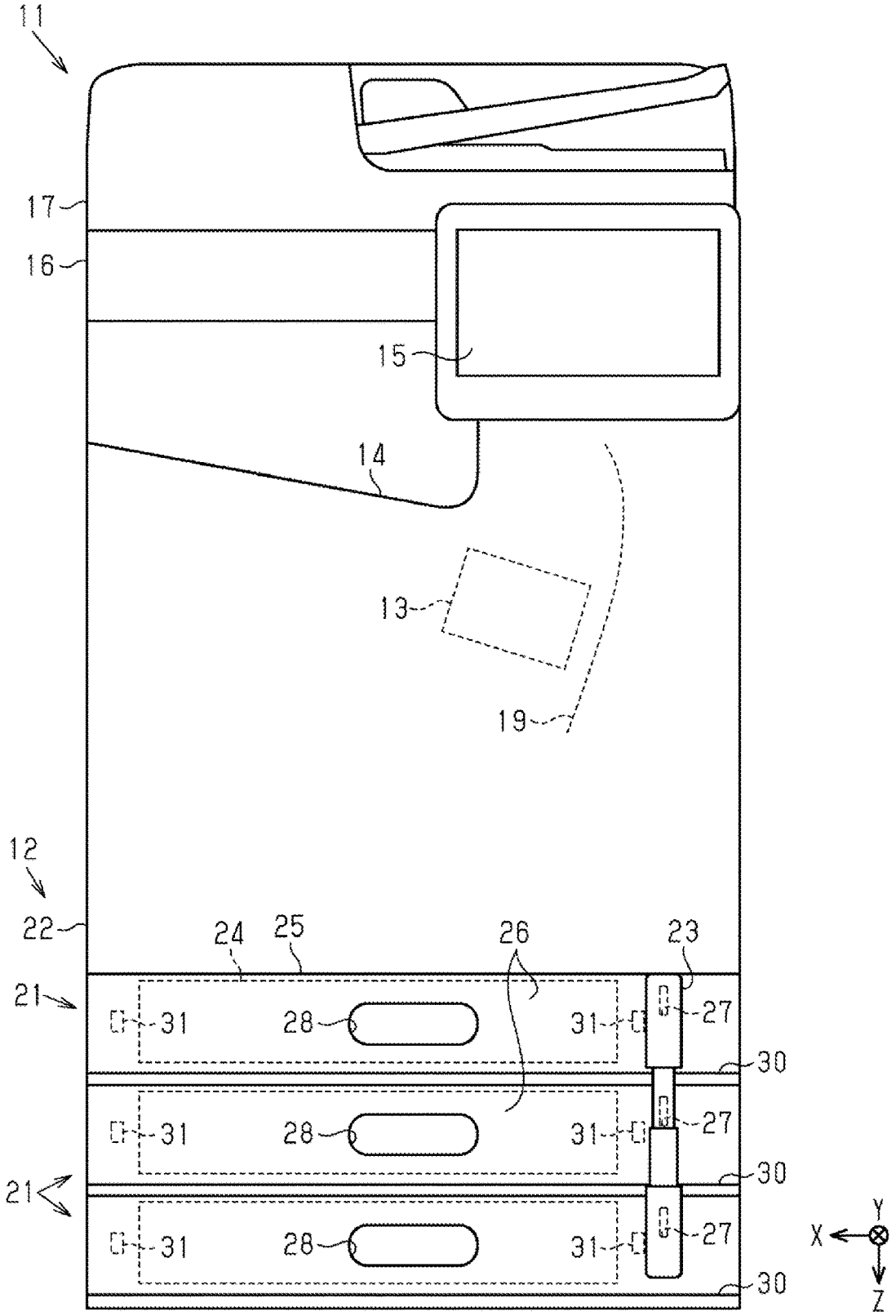
FIG. 9 is a schematic front view of a second embodiment of the image forming apparatus.

As illustrated in FIG. 9, the sheet feeding device 12 may include three containers 21. In this embodiment, one locking device 23 restricts the withdrawal of the three containers 21.

Locking Device

Figure 10:
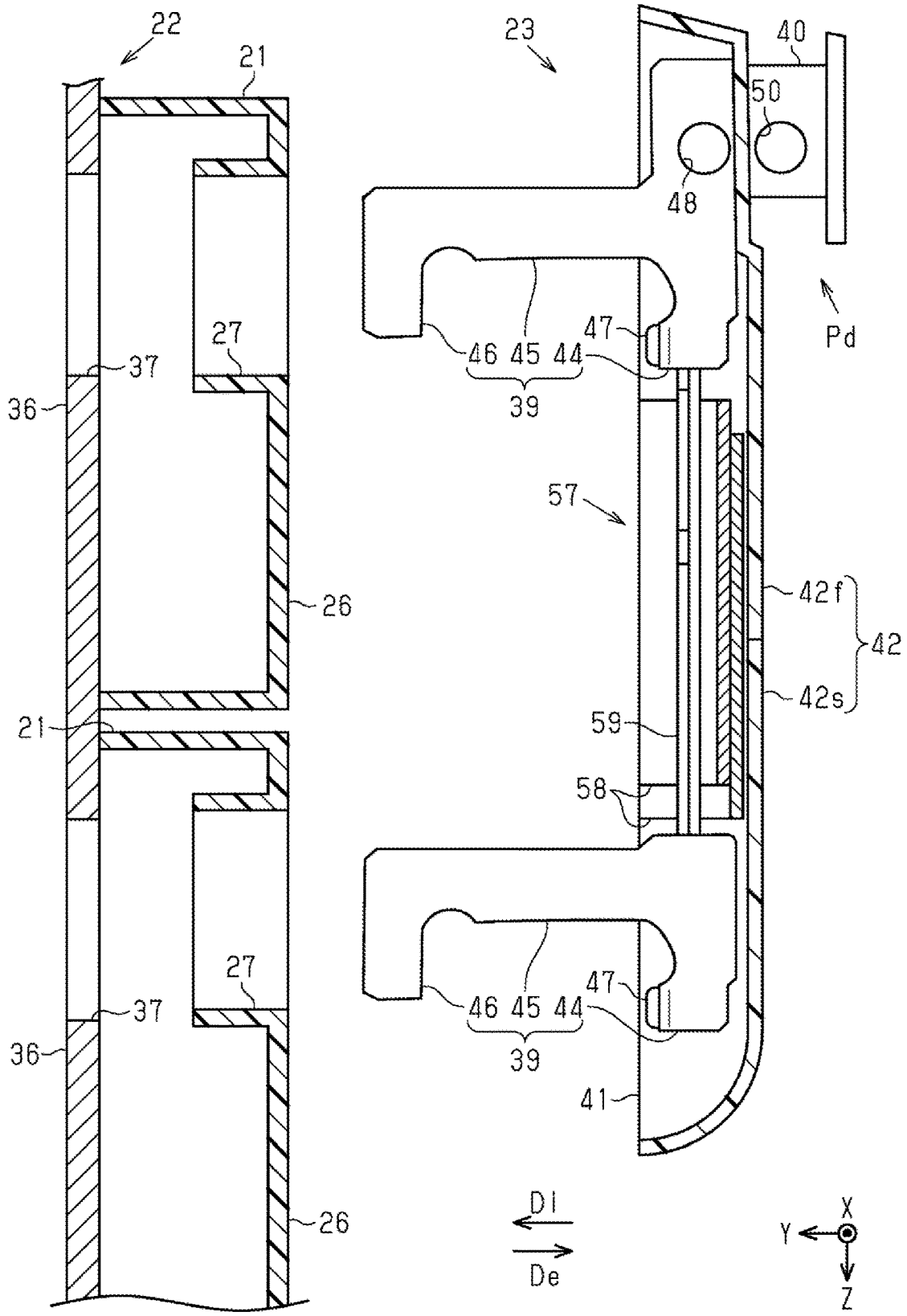
FIG. 10 is a schematic cross-sectional view of a locking device.

As illustrated in FIG. 10, the pair of engaging portions 39 may have different shapes. For example, the upper engaging portion 39 of the pair of engaging portions 39 which is located at the same position as the restricting portion 40 in the vertical direction Z may have the third hole 48, whereas the lower engaging portion 39 may not have the third hole 48. Since the third hole 48 is not provided and thus the size of the engaging portion 39 can be reduced, a weight of the locking device 23 can be reduced.

The holding portion 42 of this embodiment includes a first holding body 42*f* to which one engaging portion 39 is fixed and a second holding body 42*s* to which the other engaging portion 39 is fixed. The guiding portion 52 illustrated in FIG. 4 may be provided on the first holding body 42*f*. That is, the restricting portion 40 may be held by the first holding body 42*f*.

Figure 11:
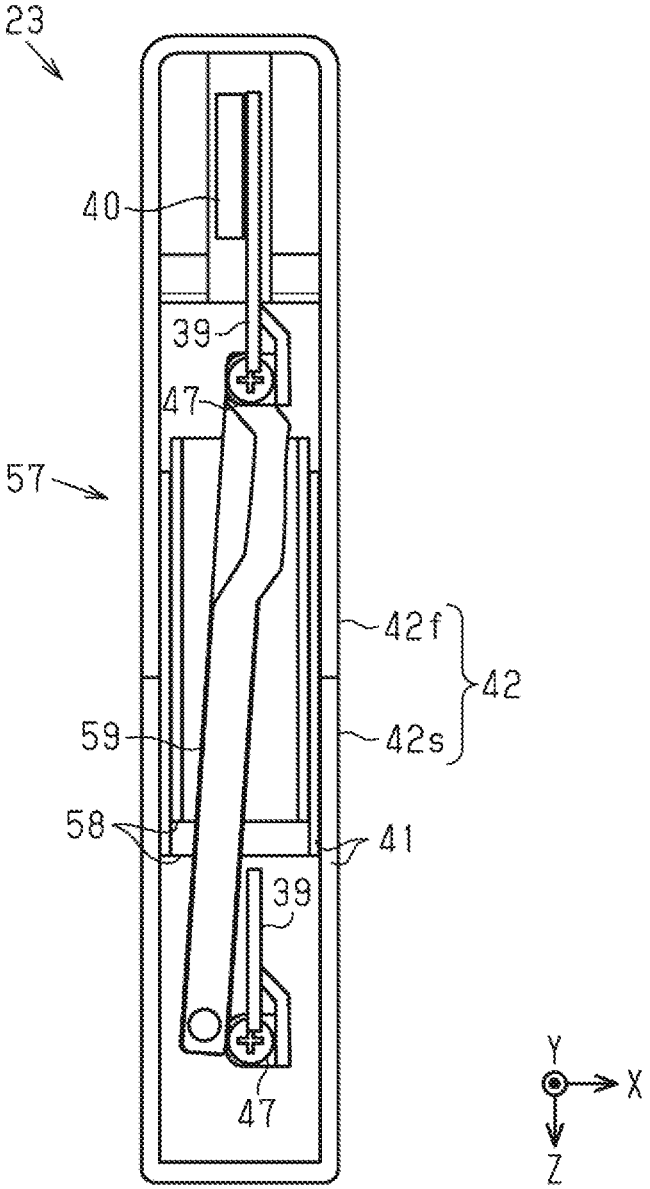
FIG. 11 is a schematic rear view illustrating a contracted state of the locking device.

In this embodiment, a state illustrated in FIG. 11 in which the first holding body 42*f* and the second holding body 42*s* are continuous is also referred to as a contracted state. In this embodiment, a state illustrated in FIG. 12 in which the first holding body 42*f* and the second holding body 42*s* are separated from each other is also referred to as an expanded state.

As illustrated in FIG. 11, the locking device 23 may include a changing mechanism 57. The changing mechanism 57 changes the interval between the engaging portions 39. The change mechanism 57 may include one or more covers 58 and a fame portion 59. The cover 58 may include the contact portion 41 as in the holding portion 42.

The cover 58 and the frame portion 59 may be stored in the holding portion 42 in a state in which the holding portion 42 is contracted. The plurality of covers 58 may have the same shape with different sizes and may be stored in a nesting shape. The frame portion 59 may be stored in a bent state. The frame portion 59 may be fixed to the holding portion 42 together with the engaging portion 39 by the screw 47.

Operation of Second Embodiment

The operation of this embodiment will be described.

As illustrated in FIG. 10, when two adjacent containers 21 are locked by the locking device 23, the operator mount the locking device 23 in a contracted state on the containers 21 and the housing 22. Since the method of mounting and removing the locking device 23 in this case is the same as that in the first embodiment, description thereof will be omitted.

Figure 12:
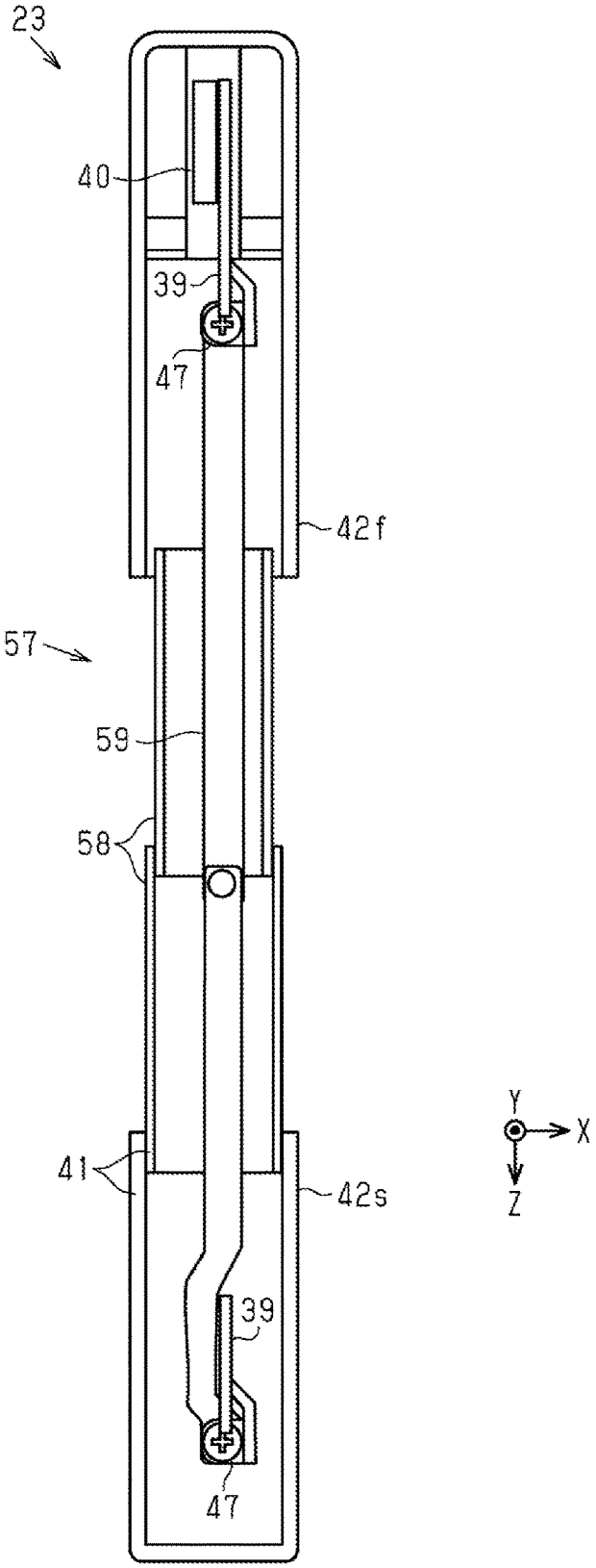
FIG. 12 is a schematic rear view showing an expanded state of the locking device.

As illustrated in FIG. 12, when three containers 21 aligned in the vertical direction Z are locked by the locking device 23, the operator brings the locking device 23 into an expanded state. To be specific, the operator removes the contracted frame portion 59 and separates the first holding body 42*f* from the second holding body 42*s* so that an interval between the pair of engaging portions 39 is twice the interval L between the first opening portions 27. The frame portion 59 is expanded. One end of the frame portion 59 is fixed to the first holding body 42*f* by the screw 47. The other end of the frame portion 59 is fixed to the second holding body 42*s* by the screw 47. The frame portion 59 maintains the first holding body 42*f* and the second holding body 42*s* in the expanded state. The cover 58 may cover the frame portion 59 and may couple the first holding body 42*f* to the second holding body 42*s*.

Figure 13:
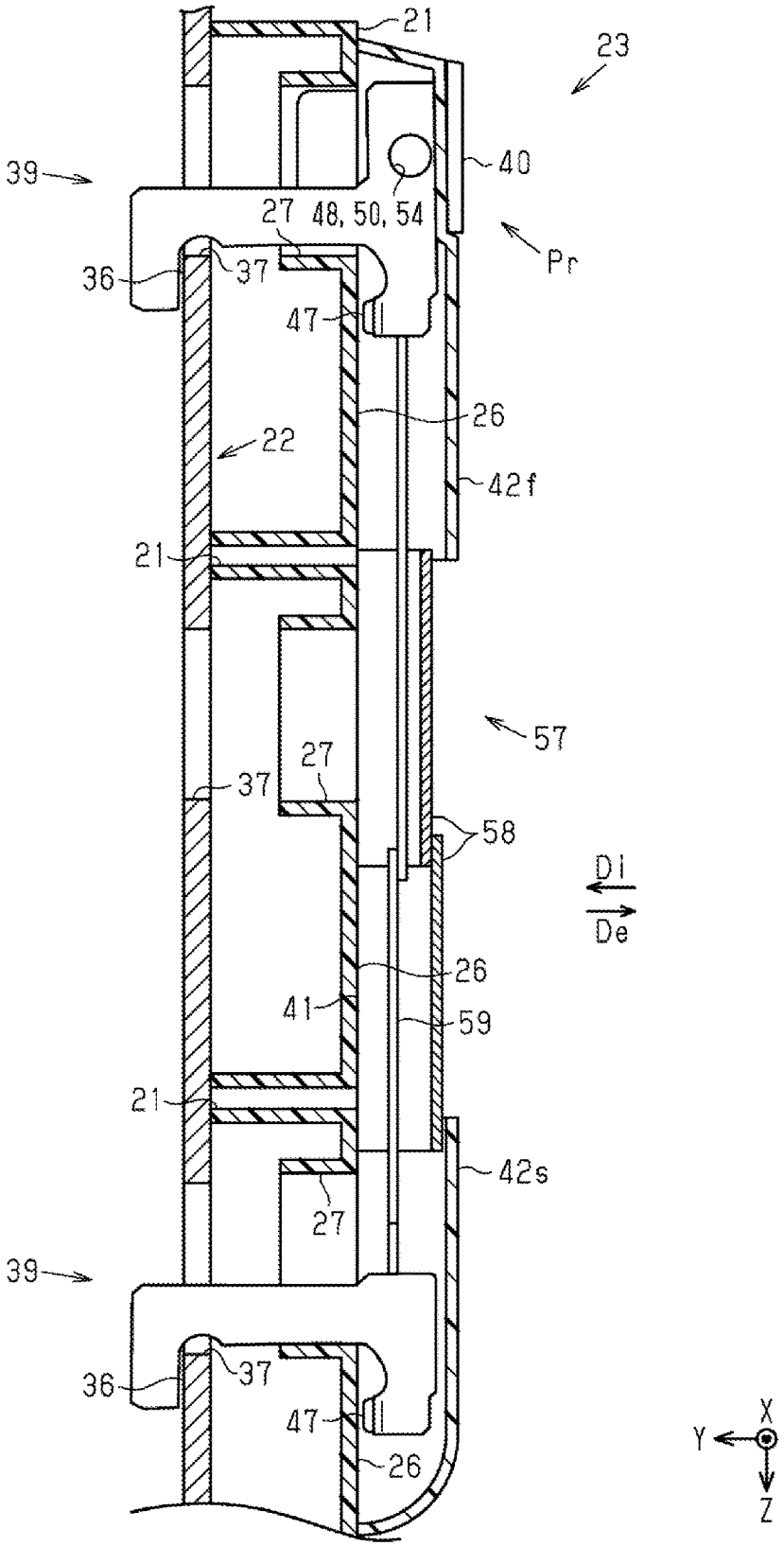
FIG. 13 is a schematic cross-sectional view of a locking device that locks a container.

As illustrated in FIG. 13, the pair of engaging portions 39 are inserted into the first opening portions 27 of the containers 21 at both ends among the three containers 21 arranged in the vertical direction Z. Specifically, the upper engaging portion 39 is inserted into the upper first opening portion 27. The lower engaging portion 39 is inserted into the lower first opening portion 27. The central first opening portion 27 is covered by the locking device 23. In the locking device 23 in the expanded state, an operation of the restricting portion 40 and a method of mounting the lock 56 are the same as those in the first embodiment, and the description thereof will be omitted.

The withdrawal of the upper container 21 is restricted by the upper container 21 coming into contact with the contact portion 41 of the first holding body 42*f*. The withdrawal of the central container 21 is restricted by the central container 21 coming into contact with the contact portion 41 of the cover 58. The withdrawal of the lower container 21 is restricted by the lower container 21 coming into contact with the contact portion 41 of the second holding body 42*s*.

Effects of Second Embodiment

Effects of this embodiment will be described.

(12) The changing mechanism 57 changes the interval between the engaging portions 39. Therefore, the combination of the containers 21 to be locked can be changed, for example, by adjusting the interval between the engaging portions 39 to the interval L between the first opening portions 27.

Third Embodiment

Next, a sheet feeding device, an image forming apparatus, and a locking device according to a third embodiment will be described with reference to the drawings. The same constituents as those in the first embodiment and the second embodiment are denoted by the same reference numerals, and redundant explanations will be omitted.

Figure 14:
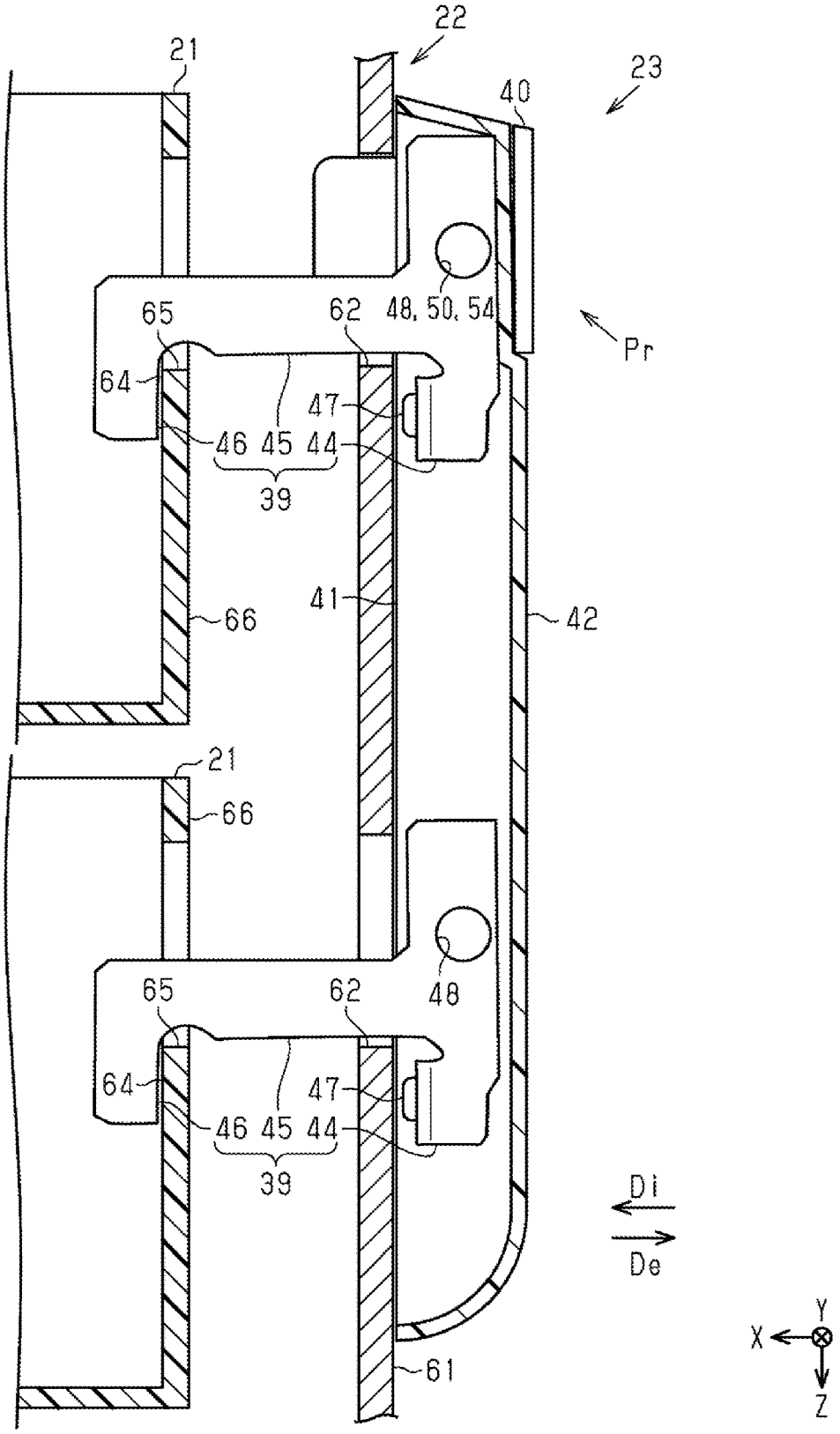
FIG. 14 is a schematic cross-sectional view of a third embodiment of the image forming apparatus.

As illustrated in FIG. 14, a plurality of second opening portions 62 are provided in a side surface 61 of the housing 22. The side surface 61 is a surface different from the front surface. The second opening portions 62 are an example of the opening portions. The number of second opening portions 62 may be the same as the number of containers 21. The insertion direction Di and the removal direction De of this embodiment are directions parallel to the X axis. The insertion direction Di is a direction perpendicular to the side surface 61 in which the second openings 62 are provided.

Each of the plurality of containers 21 includes a second engaged portion 64 which is an example of the engaged portion. Each of the plurality of containers 21 may have a second insertion portion 65. One container 21 is provided with one second engaged portion 64 and one second insertion portion 65. In this embodiment, the second engaged portion 64 respectively provided on the two containers 21 are also referred to as a pair of second engaged portions 64. The second engaged portion 64 is arranged with the corresponding second opening portion 62 in the insertion direction Di in a state in which the container 21 is mounted in the housing 22. That is, the second engaged portion 64 is located further, in the depth direction, than the second opening portion 62 in the insertion direction Di.

The second insertion portion 65 is, for example, a hole formed in a side wall 66 of the container 21. The second insertion portion 65 passes through the side wall 66 in the insertion direction Di. The second insertion portion 65 is located between the side surface 61 of the housing 22 and the second engaged portion 64 in the insertion direction Di.

Operations of Third Embodiment

The operation of this embodiment will be described.

The locking device 23 is detachably mounted on the side surface 61 of the housing 22 from the outside. Specifically, when the locking device 23 is mounted, the operator inserts the engaging portion 39 into the second opening portion 62. The protruding portion 46 passes through the second opening portion 62 and the second insertion portion 65 and moves deeper than the second engaged portion 64. The movement of the locking device 23 in the insertion direction Di is stopped by the contact portion 41 coming into contact with the side surface 61 of the housing 22.

When the operator moves the locking device 23 downward, the engaging portion 39 comes into contact with the second engaged portion 64. That is, each of the plurality of engaging portions 39 is inserted into the second opening portion 62 to be engaged with the second engaged portion 64. The pair of engaging portions 39 of this embodiment are engaged with the pair of second engaged portions 64, respectively.

Due to the protruding portion 46 coming into contact with the second engaged portion 64, the engaging portion 39 restricts the movement of the locking device 23 in the removal direction De. The contact portion 41 restricts the movement of the locking device 23 in the insertion direction Di by coming into contact with the housing 22. Due to the arm portion 45 coming into contact with an edge of the second opening portion 62, the engaging portion 39 restricts the movement of the locking device 23 in the inward direction Y and the direction opposite to the inward direction Y. Due to the arm portion 45 coming into contact with the second insertion portion 65, the engaging portion 39 restricts the withdrawal of the container 21. Therefore, the two engaging portions 39 lock the two adjacent containers 21. The locking device 23 restricts the withdrawal of the plurality of containers 21 mounted in the housing 22 from the front. The restricting portion 40 restricts disengagement of the plurality of engaging portions 39 by moving to the restriction position Pr. Since the operation of the restricting portion 40 and the method of mounting the lock 56 are the same as in the first embodiment, the description thereof will be omitted.

Effects of Third Embodiment

Effects of this embodiment will be described.

(13) Each of the plurality of containers 21 includes the second engaged portion 64. The plurality of engaging portions 39 are respectively inserted into the plurality of second opening portions 62 formed in the side surface 61 of the housing 22, and are respectively engaged with the second engaged portions 64 located further, in the depth direction, than the respective second opening portions 62. The engaging portion 39 restricts the withdrawal of the corresponding container 21 by being engaged with the second engaged portion 64. The locking device 23 can be mounted on the side surface 61 of the housing 22. Therefore, it is possible to reduce a space required to restrict the withdrawal of the plurality of containers 21.

(14) Due to the locking device 23 being mounted on the side surface 61 of the housing 22, the pair of engaging portions 39 are engaged with the pair of second engaged portions 64, respectively, thereby restricting the withdrawal of the plurality of containers 21. Therefore, it is possible to reduce the space required to restrict the withdrawal of the plurality of containers 21.

(15) The locking device 23 is mounted on the side surface 61. Therefore, the size of the image forming apparatus 11 in the inward direction Y can be reduced as compared with a case in which the locking device 23 is mounted on the front surface. It is possible to reduce an influence of the locking device 23 on a front design of the sheet feeding device 12 by mounting the locking device 23 on the side surface 61.

Modified Examples

This embodiment can be modified and implemented as follows. This embodiment and the following modified examples can be combined and implemented within a technically consistent range.

The image forming apparatus 11 may include the first opening portion 27, the first engaged portion 36, the second opening portion 62, and the second engaged portion 64. The operator may mount the locking device 23 at any place.

The image forming apparatus 11 may include a seal, a lid, or the like that covers the first opening portion 27 or the second opening portion 62. For example, the operator may remove the seal and then may mount the locking device 23.

The first engaged portion 36 and the second engaged portion 64 may be provided on the rail 31. The first engaged portion 36 and the second engaged portion 64 may be formed integrally with the rail 31. The engaging portion 39 engaged with the second engaged portion 64 may be located on a movement path of the container 21 when the container 21 is drawn out, thereby restricting the withdrawal of the container 21.

The locking device 23 may include one engaging portion 39. The restricting portion 40 may be slidable between the restriction position Pr and the release position Pd in a state in which the engaging portion 39 is engaged with the first engaged portion 36. For example, when the locking device 23 locks three containers 21, for example, the engaging portion 39 may be inserted into the first opening portion 27 of the central container 21. The contact portion 41 may be in contact with three containers 21 including the upper container 21 and the lower container 21. The contact portion 41 may come into contact with the container 21 that is not engaged with the engaging portion 39 to restrict the withdrawal thereof. The engaging portion 39 may be provided at a central portion of the contact portion 41. When the engaging portion 39 is provided at the center of the contact portion 41, a force applied to the engaging portion 39 can be reduced as compared with a case in which the engaging portion 39 is provided at an end of the contact portion 41.

One or more engaging portions 39 may be inserted into one or more first opening portions 27 formed in one container 21.

In the first embodiment and the second embodiment, the locking device 23 may be mounted in a vertically inverted posture. That is, the protruding portion 46 may protrude upward from the arm portion 45. The first engaged portion 36 may be located higher than the first insertion portion 37. The second engaged portion 64 may be located higher than the second insertion portion 65. The operator may insert the engaging portion 39 with the first opening portion 27 or the second opening portion 62 and then may engage the engaging portion 39 with the first engaged portion 36 or the second engaged portion 64 by moving the locking device 23 upward.

A surface of the protruding portion 46 that comes into contact with the first engaged portion 36 or the second engaged portion 64 may be non-parallel to the first engaged portion 36 and the second engaged portion 64. For example, in the protruding portion 46, a distance from a proximal end of the protruding portion 46 to the contact portion 41 in the insertion direction Di may be shorter than a distance from a distal end of the protruding portion 46 to the contact portion 41. The engaging portion 39 inserted into the first opening portion 27 or the second opening portion 62 may be moved in a direction in which the protruding portion 46 protrudes from the arm portion 45, thereby fastening the container 21 into the housing 22 by the protruding portion 46 and the contact portion 41. Accordingly, for example, even when the protruding portion 46 protrudes upward from the arm portion 45, the locking device 23 can be easily maintained at a position at which the engaging portion 39 is engaged with the first engaged portion 36 or the second engaged portion 64.

In the first embodiment, the protruding portion 46 may protrude from the arm portion 45 in the width direction X or in a direction opposite to the width direction X. The engaging portion 39 inserted into the first opening portion 27 may be engaged with the first engaged portion 36 by moving the locking device 23 in the width direction X or the direction opposite to the width direction X. The restricting portion 40 may enter a gap between the engaging portion 39 and the first opening portion 27 in the width direction X to restrict disengagement of the engaging portion 39.

The first opening portion 27, the second opening portion 62, the first insertion portion 37, and the second insertion portion 65 may be notches.

The first hole 50 may overlap the third hole 48 in a state in which the restricting portion 40 is located at the restriction position Pr. The guiding portion 52 may not cover the third hole 48. In this case, the second hole 54 may not be provided in the guiding portion 52.

The three or more first opening portions 27 may have different intervals L. The three or more second opening portions 62 may have the same interval L or different intervals L.

The storing portion 24 may be provided at a position at which it overlaps the first opening portion 27 in the width direction X.

The engaging portion 39 may be made of a resin.

The engaging portion 39 may have a rod shape. The engaging portion 39 may have a corrugated plate shape.

The engaging portion 39 may be fixed to the holding portion 42 by employing, for example, a caulking fixing structure or a fixing structure using an adhesive.

The protruding portion 46 may be provided at any position of the arm portion 45 in the insertion direction Di. For example, the protruding portion 46 may be provided at a central portion of the arm portion 45.

The locking device 23 may not include the guiding portion 52. For example, the restricting portion 40 may be moved between the restriction position Pr and the release position Pd by rotating about an axis. The restricting portion 40 may rotate about an axis perpendicular to the insertion direction Di. The restricting portion 40 may be a screw that moves in the insertion direction Di by rotating about an axis parallel to the insertion direction Di.

The restricting portion 40 may move between the restriction position Pr and the release position Pd by sliding in the vertical direction Z. The guiding portion 52 may guide the restricting portion 40 in the vertical direction Z.

The container 21 stores consumables. For example, the container 21 may store an ink cartridge, an ink storage bag, or the like (not illustrated). The locking device 23 may lock the containers 21 that stores different types of consumables together. For example, the locking device 23 may lock the container 21 that stores the ink cartridge and the container 21 that stores the sheet member 19 together.

The sheet feeding device 12 may be provided in a scanner including a reading unit that reads an image formed at the sheet member 19.

A device including the image forming unit 13 and the sheet feeding device 12 may be configured as separate bodies.

The image forming apparatus 11 may be an apparatus that prints an image such as characters, pictures, photographs, and the like by depositing a liquid such as ink or toner on the sheet member 19, and may be a serial printer, a lateral printer, a line printer, a page printer, or the like. Further, the image forming apparatus may be an offset printing apparatus, a textile printing apparatus, or the like.

Definition

The expression "at least one" as used herein means "one or more" of the desired option. As an example, the expression "at least one" as used herein means "only one option" or "both of two options" when the number of options is two. As another example, the expression "at least one" as used herein means "only one option" or "any combination of two or more options" when the number of options is three or more.

Supplementary Description

Hereinafter, technical concepts and effects thereof that are understood from the above-described embodiments and modified examples will be described.

(A) A sheet feeding device includes a plurality of containers configured to store sheet members, a housing in which the plurality of containers are mounted from a front, and a locking device configured to restrict withdrawal of the plurality of containers mounted in the housing, wherein an opening portion is provided in a front surface of each of the plurality of containers, the housing includes an engaged portion, and the locking device includes an engaging portion that is inserted into the opening portion and engaged with the engaged portion located further, in the depth direction, than the opening portion, a restricting portion that restricts disengagement of the engaging portion, and a contact portion that comes into contact with the front surfaces of the plurality of containers.

With such a configuration, the movement of the locking device is restricted by the engaging portion being engaged with the engaged portion. The contact portion comes into contact with the front surfaces of the plurality of containers. That is, the locking device can restrict the withdrawal of the plurality of containers by pressing the plurality of containers with the contact portion. The engaging portion is inserted into the opening portion formed in the front surface of the container and is engaged with the engaged portion located further, in the depth direction, than the opening portion. Thus, the locking device can be mounted from the front. Thus, a space required to restrict the withdrawal of the plurality of containers can be reduced.

(B) The sheet feeding device includes a plurality of containers configured to store sheet members, a housing in which the plurality of containers are mounted from a front, and a locking device configured to restrict withdrawal of the plurality of containers mounted in the housing, wherein a plurality of opening portions are provided in a side surface of the housing, each of the plurality of containers has an engaged portion, and the locking device includes a plurality of engaging portions that are inserted into the opening portions and are engaged with the engaged portions located further, in a depth direction, than the plurality of opening portions, and a restricting portion that restricts disengagement of the plurality of engaging portions.

With such a configuration, each of the plurality of containers includes the engaged portion. The plurality of engaging portions are respectively inserted into the opening portions formed in the side surface of the housing, and are respectively engaged with the engaged portions located further, in the depth direction, than the opening portions. The engaging portion restricts withdrawal of the corresponding container by being engaged with the engaged portion. The locking device can be mounted on the side surface of the housing. Thus, a space required to restrict the withdrawal of the plurality of containers can be reduced.

(C) In the sheet feeding device, the locking device may include a guiding portion configured to guide movement of the restricting portion, and the restricting portion may be configured to slide between a restriction position at which disengagement of the engaging portion is restricted and a release position different from the restriction position in a state in which the engaging portion is engaged with the engaged portion.

With such a configuration, the guiding portion guides the restricting portion to be slidable. Therefore, the restricting portion can easily move between the restriction position and the release position. Therefore, it is possible to easily attach and detach the locking device.

(D) In the sheet feeding device, the engaging portion may include an arm portion extending in an insertion direction and a protruding portion protruding downward from a distal end of the arm portion, and the protruding portion may be configured to be engaged with the engaged portion.

For example, when the protruding portion protrudes upward, the engagement of the locking device may be released by its own weight. In this regard, with such a configuration, since the protruding portion protrudes downward, it is possible to make it difficult for the engagement to be released.

(E) In the sheet feeding device, the engaging portion may be a planar plate made of a metal.

With such a configuration, since the engaging portion is a metal planar plate, strength can be easily ensured.

(F) In the sheet feeding device, the container may include a storing portion that stores the sheet members, and the storing portion may be provided at a position different from the opening portion in a width direction.

With such a configuration, the opening portion and the storing portion are provided to be displaced from each other in the width direction. A space into which the engaging portion is inserted is required at the inside of the opening portion. Therefore, it is possible to reduce a size in an inward direction compared to a case in which the storing portion and the opening portion are provided at the same position in the width direction.

(G) In the sheet feeding device, a first hole may be provided in the restricting portion, a second hole may be provided in the guiding portion, and the first hole and the second hole may overlap each other in a state in which the restricting portion is located at the restriction position.

With such a configuration, the first hole and the second hole overlap each other in the state in which the restricting portion is located at the restriction position. For example, a lock such as a padlock or a wire lock can be installed in the overlapping first and second holes. Therefore, the engaging portion engaged with the engaged portion can be easily locked.

(H) In the sheet feeding device, the housing may include a main body including a first mounting portion in which a first container among the plurality of containers is mounted, and an attachment including a second mounting portion in which a second container among the plurality of containers is mounted, and the attachment may be configured to be attached to and detached from the main body.

With such a configuration, the attachment is attachable to and detachable from the main body. The containers can be added by mounting the attachments on the main body. The locking device can restrict withdrawal of a plurality of containers even when the containers can be added.

(I) The sheet feeding device may include three or more containers, intervals between the opening portions of the containers adjacent to each other may be the same, the locking device may include two engaging portions, and the two engaging portions may lock the two adjacent containers.

With such a configuration, in the three or more opening portions, the intervals between the adjacent opening portions are the same. The locking device includes two engaging portions. Therefore, any adjacent containers can be locked by the locking device.

(J) In the sheet feeding device, the locking device may include a changing mechanism that changes an interval between the engaging portions.

With such a configuration, the changing mechanism changes the interval between the engaging portions. Therefore, for example, the combination of containers to be locked can be changed by adjusting an interval between the engaging portions to an interval between the opening portions.

(K) An image forming apparatus includes the sheet feeding device configured as described above, and an image forming unit configured to form an image on the sheet member.

With such a configuration, the same effects as those of the sheet feeding device described above can be obtained.

(L) The locking device is a locking device that restricts withdrawal of a plurality of containers mounted in a housing from a front, the locking device including a pair of engaging portions that are respectively engaged with a pair of engaged portions of the housing or the container, and a restricting portion that restricts disengagement of the pair of engaging portions, and the locking device being detachably mounted to a front surface of the container or a side surface of the housing from the outside.

With such a configuration, due to the locking device being mounted on the front surface of the container or the side surface of the housing, the pair of engaging portions are engaged with the pair of engaged portions, respectively, and withdrawal of the plurality of containers are restricted. Thus, a space required to restrict the withdrawal of the plurality of containers can be reduced.

(M) The locking device may further include a guiding portion configured to guide movement of the restricting portion, and the restricting portion may be configured to slide between a restriction position at which disengagement of the engaging portion is restricted and a release position different from the restriction position in a state in which the pair of engaging portions are engaged with the engaged portions, respectively. With such a configuration, the same effects as those of the sheet feeding device described above can be obtained.

(N) In the locking device, a first hole may be provided in the restricting portion, a second hole may be provided in the guiding portion, and the first hole and the second hole may overlap each other in a state in which the restricting portion is located at the restriction position. With such a configuration, the same effects as those of the sheet feeding device described above can be obtained.

(O) The locking device may further include a holding portion to which each of the pair of engaging portions is fixed, and the pair of engaging portions may have the same shape.

With such a configuration, each of the pair of engaging portions is fixed to the holding portion. The pair of engaging portions have the same shape. That is, since the pair of engaging portions can be formed of a common component, the cost can be reduced.

What is claimed is:

1. A sheet feeding device comprising:

a plurality of containers configured to store sheet members;

a housing in which the plurality of containers are mounted from a front; and a locking device configured to restrict withdrawal of the plurality of containers mounted in the housing, wherein an opening portion is provided in a front surface of each of the plurality of containers, the housing includes an engaged portion, and the locking device includes:

an engaging portion that is inserted into the opening portion and engaged with the engaged portion located further, in a depth direction, than the opening portion;

a restricting portion that restricts disengagement of the engaging portion; and a contact portion that comes into contact with the front surfaces of the plurality of containers.

2. The sheet feeding device according to claim 1, wherein the locking device includes a guiding portion configured to guide movement of the restricting portion, and the restricting portion is configured to slide between a restriction position at which disengagement of the engaging portion is restricted and a release position different from the restriction position in a state in which the engaging portion is engaged with the engaged portion.

3. The sheet feeding device according to claim 2, wherein a first hole is provided in the restricting portion, a second hole is provided in the guiding portion, and the first hole and the second hole overlap each other in a state in which the restricting portion is located at the restriction position.

4. The sheet feeding device according to claim 1, wherein the engaging portion includes:

an arm portion extending in an insertion direction; and a protruding portion protruding downward from a distal end of the arm portion, and the protruding portion is configured to be engaged with the engaged portion.

5. The sheet feeding device according to claim 1, wherein the engaging portion is a planar plate made of a metal.

6. The sheet feeding device according to claim 1, wherein the container includes a storing portion that stores the sheet members, and the storing portion is provided at a position different from the opening portion in a width direction.

7. The sheet feeding device according to claim 1, wherein the housing includes:

a main body including a first mounting portion in which a first container among the plurality of containers is mounted, and an attachment including a second mounting portion in which a second container among the plurality of containers is mounted, and the attachment is configured to be attached to and detached from the main body.

8. The sheet feeding device according to claim 1, wherein three or more of the containers are provided, intervals between the opening portions of the containers adjacent to each other are the same, the locking device includes two engaging portions, and the two engaging portions lock the two containers adjacent to each other.

9. The sheet feeding device according to claim 8, wherein the locking device includes a changing mechanism that changes an interval between the engaging portions.

10. An image forming apparatus comprising:

the sheet feeding device according to claim 1; and an image forming unit configured to form an image on the sheet member.

11. A sheet feeding device comprising:

a plurality of containers configured to store sheet members;

a housing in which the plurality of containers are mounted from a front; and a locking device configured to restrict withdrawal of the plurality of containers mounted in the housing, wherein a plurality of opening portions are provided in a side surface of the housing, each of the plurality of containers includes an engaged portion, and the locking device includes:

a plurality of engaging portions that are inserted into the opening portions and are engaged with the engaged portions located further, in a depth direction, than the plurality of opening portions; and a restricting portion that restricts disengagement of the plurality of engaging portions.

12. A locking device that restricts withdrawal of a plurality of containers mounted in a housing from a front, comprising:

a first engaging portion and a second engaging portion that are respectively engaged with a pair of engaged portions of the housing or the container;

a holding portion to which each of the first engaging portion and the second engaging portion is fixed;

a restricting portion that restricts disengagement of the first engaging portion and the second engaging portion; and a guiding portion configured to guide movement of the restricting portion, wherein the locking device is detachably mounted to a front surface of the container or a side surface of the housing from outside an interior of the container or the housing, the holding portion contacting the front surface of the container or the side surface of the housing from outside the interior of the container or the housing, the first and second engaging portions being fixed to the holding portion at different locations, the first and second engaging portions are separated from each other, the restricting portion is positioned adjacent the first engaging portion, but not the second engaging portion, in an up-down direction, the restricting portion is configured to slide between a restriction position at which disengagement of the first and second engaging portions is restricted and a release position different from the restriction position in a state in which the first engaging portion and the second engaging portion are engaged with the engaged portions, respectively, a first hole is provided in the restricting portion, a second hole is provided in the guiding portion, and the first hole and the second hole overlap each other in a state in which the restricting portion is located at the restriction position.

13. The locking device according to claim 12, wherein the first engaging portion and the second engaging portion have the same shape.

14. The locking device according to claim 12, wherein the first and second engaging portions include a base portion, an arm portion, and a protruding portion that engages with the pair of engaged portions of the housing or the container.

15. A locking device that restricts withdrawal of a plurality of containers mounted in a housing from a front, comprising:

a first engaging portion and a second engaging portion that are respectively engaged with a pair of engaged portions of the housing or the container;

a holding portion to which each of the first engaging portion and the second engaging portion is fixed; and a restricting portion that restricts disengagement of the first engaging portion and the second engaging portion, wherein the locking device is detachably mounted to a front surface of the container or a side surface of the housing from outside an interior of the container or the housing, the holding portion contacting the front surface of the container or the side surface of the housing from outside the interior of the container or the housing, the first and second engaging portions being fixed to the holding portion at different locations, the first and second engaging portions are separated from each other, the restricting portion is positioned adjacent the first engaging portion, but not the second engaging portion, in an up-down direction, and the restricting portion is configured to slide between a restriction position at which disengagement of the first and second engaging portions is restricted and a release position different from the restriction position in a state in which the first engaging portion and the second engaging portion are engaged with the engaged portions, respectively, the restricting portion remaining connected to the holding portion in both the restriction position and the release position.

16. The locking device according to claim 15, further comprising a guiding portion configured to guide movement of the restricting portion.

17. The locking device according to claim 16, wherein a first hole is provided in the restricting portion, a second hole is provided in the guiding portion, and the first hole and the second hole overlap each other in a state in which the restricting portion is located at the restriction position.

18. The locking device according to claim 15, wherein the first engaging portion and the second engaging portion have the same shape.

19. The locking device according to claim 15, wherein the first and second engaging portions include a base portion, an arm portion, and a protruding portion that engages with the pair of engaged portions of the housing or the container.

* * * * *